US008020867B2

(12) United States Patent
Cheng

(10) Patent No.: US 8,020,867 B2
(45) Date of Patent: Sep. 20, 2011

(54) TOY BLOCK ASSEMBLY PUZZLE

(75) Inventor: Ming-Hsien Cheng, Jhonghe (TW)

(73) Assignee: 684899 Braintelligent Co., Ltd, Jhonghe Dist., New Taipei (TW)

( * ) Notice: Subject to any disclaimer, the term of this patent is extended or adjusted under 35 U.S.C. 154(b) by 170 days.

(21) Appl. No.: 12/382,698

(22) Filed: Mar. 23, 2009

(65) Prior Publication Data

US 2010/0237561 A1 Sep. 23, 2010

(51) Int. Cl.
*A63F 9/06* (2006.01)

(52) U.S. Cl. ..... 273/157 R; 273/156

(58) Field of Classification Search ..... 273/157 R, 273/153 R, 276, 153 P, 241
See application file for complete search history.

(56) References Cited

U.S. PATENT DOCUMENTS 3,420,527 A * 1/1969 Morin ..... 273/157 R
3,945,645 A * 3/1976 Roberts ..... 273/157 R
3,993,313 A * 11/1976 Tillotson ..... 273/157 R
4,629,192 A * 12/1986 Nichols ..... 273/241
4,974,849 A * 12/1990 Kasuya et al. ..... 273/157 R
4,988,103 A * 1/1991 Cheng ..... 273/157 R
5,301,953 A * 4/1994 Levin ..... 273/276
5,988,640 A * 11/1999 Wheeler ..... 273/241
6,220,919 B1 * 4/2001 Cheng ..... 273/153 P
6,637,745 B1 * 10/2003 Vardanyan ..... 273/153 P
6,702,285 B2 * 3/2004 Cheng ..... 273/153 R
6,708,973 B1 * 3/2004 Hall et al. ..... 273/157 R
7,040,621 B2 * 5/2006 Cheng ..... 273/157 R
2006/0076730 A1 * 4/2006 Chiou ..... 273/153 P
2007/0187890 A1 * 8/2007 Cheng ..... 273/153 P

* cited by examiner

*Primary Examiner* — Steven Wong

(57) ABSTRACT

A toy block assembly puzzle, which is arranged diagonally, ideal for advanced users, comprises: a game tray (20) and plurality of assembly pieces (10) which will be arranged in a concave recess (21) of said game tray (20), characterized in that: said concave recess (21) of said game tray (20) including 50 concave slots (22), arranged in 11 rows; each odd row (row 1, 3, 5, 7, 9, 11) having 5 slots and each even row (row 2, 4, 6, 8, 10) having 4 slots; all slots (22) of said odd and even row are staggered arranged, forming 10 diagonal rows, each having an angle of 45 degree enclosed by said diagonal row and a border of said game tray (20); said assembly pieces (10) comprise 11 building blocks (1A~1K), each having a different shape and formed by 3~5 adjacent units; a total sum of units of said 11 building blocks (1A~1K) are 50 units; said building blocks (1A~1K) are placed diagonally with an oblique angle of 45 degree, into said 50 concave slots (22), which are provided on the game tray (20).

2 Claims, 7 Drawing Sheets

TOY BLOCK ASSEMBLY PUZZLE

FIELD OF THE INVENTION

The present invention is related to a toy block assembly puzzle which all assembly pieces are arranged diagonally on a game tray.

DESCRIPTION OF PRIOR ART

A toy block assembly puzzle is a gaming device that allows the player arranges building blocks of different shapes on a specific game board to form a specific figure or shape; it is believed that said puzzle game has intellectual benefits for developing and improving logical concepts.

In cited reference U.S. Pat. No. 6,220,919 entitled "Assembled Building Block for Forming Various Geometrical Shapes with Corners Having Angles 60 Degrees, 90 Degrees and 120 Degrees", filed by the applicant, it disclosed a puzzle game as shown in FIG. 1, comprises a game tray (30) having 55 round holes (31) forming a 5×11 rectangular matrix on the surface; By utilizing 12 different assembly units (3A~3L) (FIG. 2), each is formed by 3 to 5 elements, to cover all 55 round holes (31) on the game tray (30).

Said cited puzzle game, as disclosed above, the matrix having 5 X-axes and 11 Y-axes; intervals between two round holes (31) of each X-axis and Y-axis are equal; and each X-axis is perpendicular to each Y-axis. A user usually arranges assembly blocks to form the border then to complete the puzzle and since our brain has better perception for objects with right angle, it is easier to arrange assembly units (3A~3L) on said game tray (30) with above formation. It may entertain the beginner; however, for most advanced player or challenge lovers, it soon loses its attraction. Therefore, to design a more challenging building block puzzle has become the primary object of the present invention.

Secondly, to increase the complexity of the puzzle, it usually augments the number of assembly pieces; however, it also enlarges the size of the game set, increasing the inconvenience for the storage. It is believed that the oblique insertion of assembly pieces of present invention can raise the difficulty of the puzzle with less number of assembly pieces, providing a high intellectual game with a compact size.

SUMMARY OF THE INVENTION

An advanced intellectual toy block assembly puzzle comprises a game tray (20) and plurality of assembly pieces (10) which can be located in a concave recess (21) of said game tray (20), characterized in that:

Said concave recess (21) is provided on upper/base surface of said game tray (20), said concave recess (21) including 50 concave slots (22), arranged in 11 rows; each odd row (row 1, 3, 5, 7, 9, 11) having 5 slots and each even row (row 2, 4, 6, 8, 10) having 4 slots; each adjacent odd and even row are staggered arranged which each slot of said even row inclines toward a slot of said odd row by an angle of 45 degree.

Said assembly pieces (10) comprising 11 building blocks (1A~1K), each having a different shape and formed by 3~5 adjacent units; a total sum of units of said 11 building blocks (1A~1K) are 50 units, said building blocks (1A~1K) are inserted diagonally with an oblique angle of 45 degree, into said 50 concave slots (22), provided on the game tray (20); said 11 building blocks (1A~1K) consisting following shapes, illustrating by the X-axis and Y-axis of a vector, wherein:

1. The block (1A) is formed by 4 units (a1~a4), a first to third unit (a1~a3) are aligned vertically along the X-axis while a fourth unit (a4) and the third unit (a3) are aligned horizontally along the Y-axis;
2. The block (1B) is formed by 5 units (b1~b5), a first to third unit (b1~b3) and a fourth to fifth unit (b4, b5) are aligned vertically along the X-axis, while the second and forth units (b2, b4), the third and fifth unit (b3, b5), both are aligned horizontally along two parallel Y-axes;
3. The block (1C) is formed by 5 units (c1~c5), a first to forth unit (c1~c4) are aligned vertically along the X-axis while a fifth unit and the third unit (c5, c3) are aligned horizontally along the Y-axis;
4. The block (1D) is formed by 3 units (d1~d3), a first and second unit (d1~d2) are aligned vertically along the X-axis while a third and the second unit (d3, d2) are aligned horizontally along the Y-axis;
5. The block (1E) is formed by 5 units (e1~e5), a first and second unit (e1~e2), a third and forth unit (e3, e4), both are aligned vertically along two parallel X-axes, while the second and the third unit (e2, e3), a fifth and the forth unit (e5, e4), both are aligned horizontally along two parallel Y-axes;
6. The block (1F) is formed by 5 units (f1~f5), a first to third unit (c1~c4) are aligned vertically along the X-axis, while the first, a forth and a fifth unit (f1, f4, f5) are aligned horizontally along the Y-axis;
7. The block (1G) is formed by 4 units (g1~g4), a first to third unit (g1~g3) are aligned vertically along the X-axis, while a second and the forth unit (g2, g4) are aligned horizontally along the Y-axis;
8. The block (1H) is formed by 4 units (h1~h4), a first to forth unit (h1~h4) are aligned vertically along the X-axis;
9. The block (1I) is formed by 5 units (i1~i5), a first and second unit (i1,i2) are aligned vertically along the X-axis, while the second to fifth unit (i2~i5) are aligned horizontally along the Y-axis;
10. The block (1J) is formed by 5 units (j1~j5), a first to third unit (j1~j3), a forth and fifth unit (j4, j5), both are aligned vertically along two parallel X-axes, while the third and forth (j3, j4) are aligned horizontally along the Y-axis;
11. The block (1K) is formed by 5 units (k1~k5), a first and forth unit (k1, k4), a third and fifth (k3, k5), both are aligned vertically along two parallel X-axes, while the first to third unit (k1~k3) are aligned horizontally along the Y-axis.

Comparison with the Prior Art

1. Unlike the conventional puzzle that arranged vertically and horizontally, a player can use assembly pieces to form the borders first, which facilitates to complete the puzzle; all 11 distinct building blocks (1A~1K) of the present invention must be arranged diagonally into all 50 concave slots (22) of a concave recess (20) with an insertion angle of 45 degrees. Since all building blocks (1A~1K) are formed with right angles, the oblique insertion angle intensify the difficulty of the game to the puzzle solver.
2. The oblique insertion angle also limits the possible solutions to the puzzle. For cited reference U.S. Pat. No. 6,220,919, it contains 360,984 possible solutions for a two dimensional rectangle having 5×11 slots; however, the present invention is believed to have possible solutions no more than a hundred, providing more challenging to the game.
3. All 11 assembly pieces and a game tray having 50 slots, diminish the size of the present invention compare to the prior art, which reducing the cost of manufacture, allowing the game being more economic.

DETAIL DESCRIPTION OF THE PREFERRED EMBODIMENTS

The present invention discloses four applicable embodiments, all four embodiments are described in detail regarding appended drawings hereinafter.

First Embodiment

Figure 1:
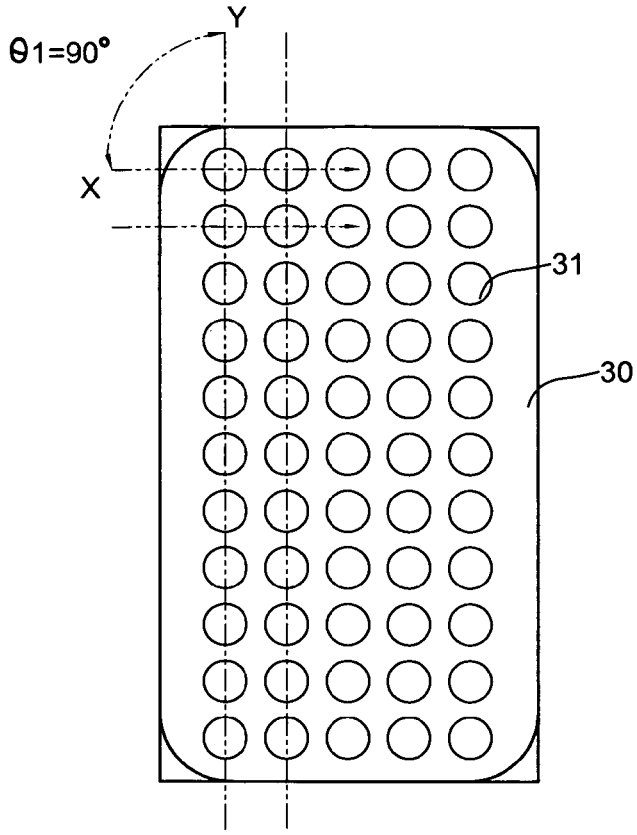
FIG. 1 Prior Art
FIG. 1 is a top plan view of the game board of the prior art.
Figure 2:
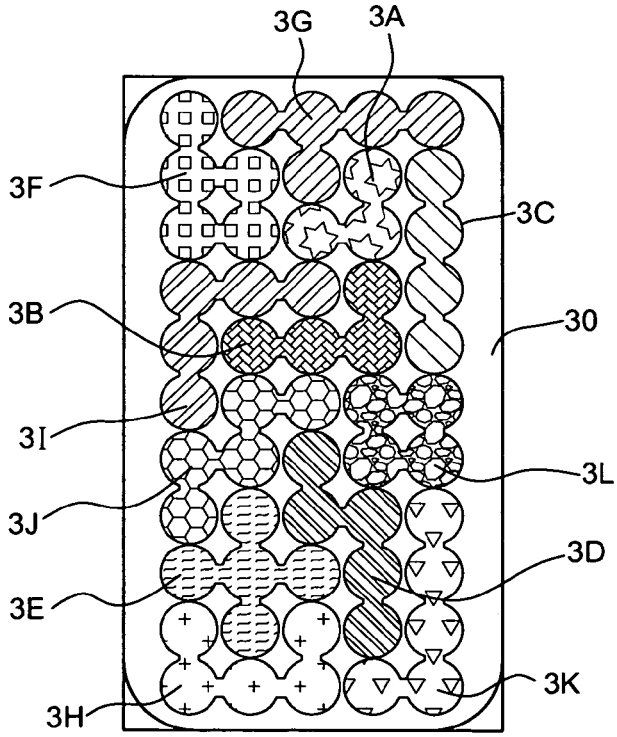
FIG. 2 Prior Art
FIG. 2 is a top plan view of the FIG. 1 carrying 12 assembly pieces.
Figure 3:
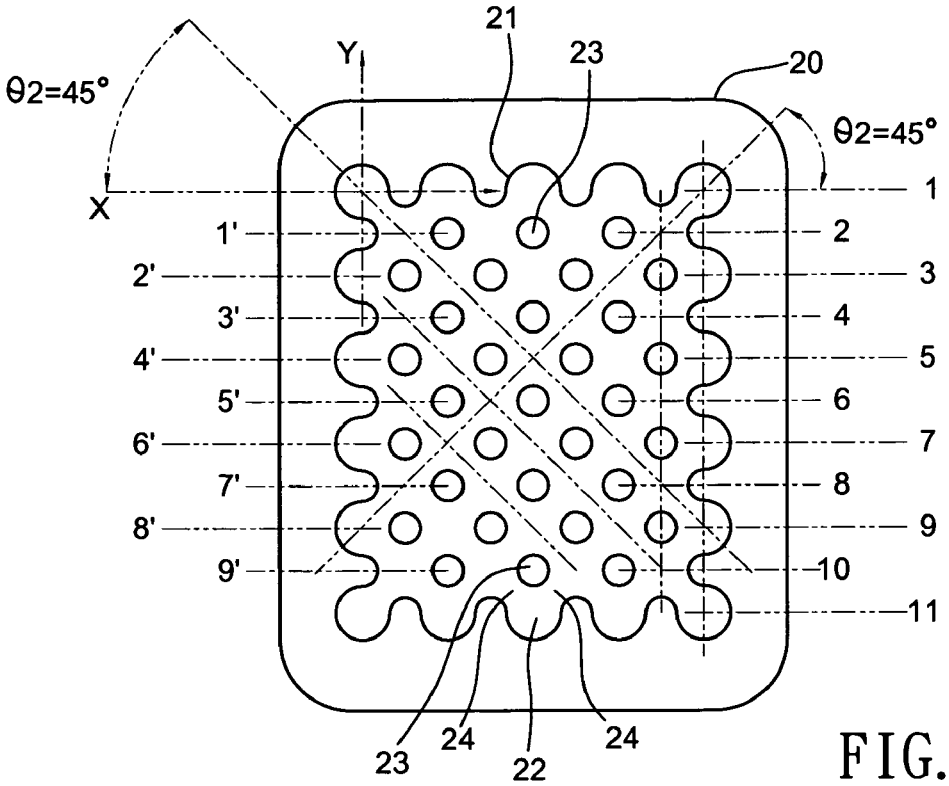
FIG. 3 is a top plan view of game tray of the first embodiment of the present invention.
Figure 4:
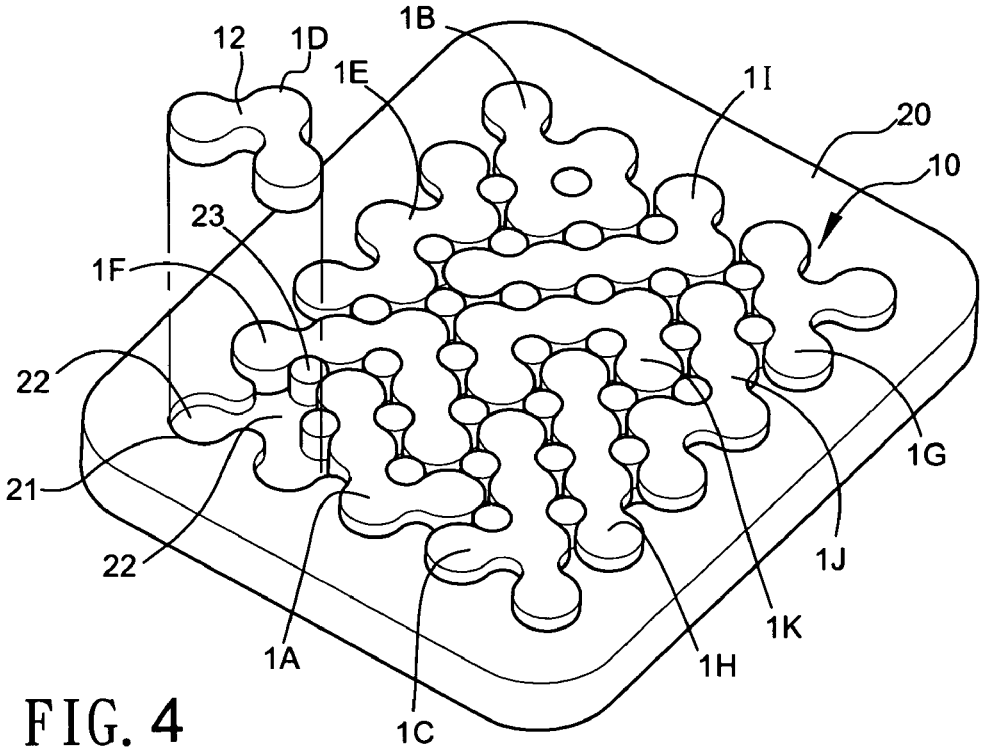
FIG. 4 is a perspective view of the FIG. 3 coupled with all 11 assembly pieces.
Figure 5:
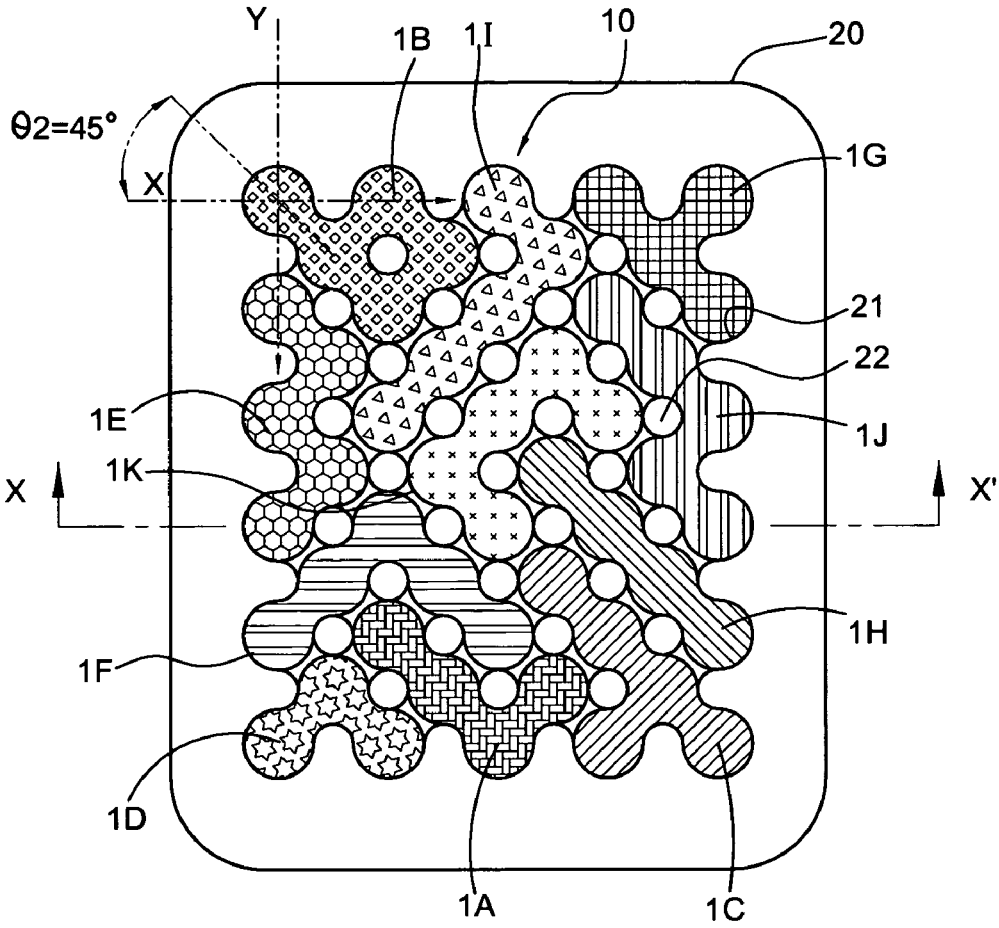
FIG. 5 is a schematic view of the FIG. 4.
Figure 6:
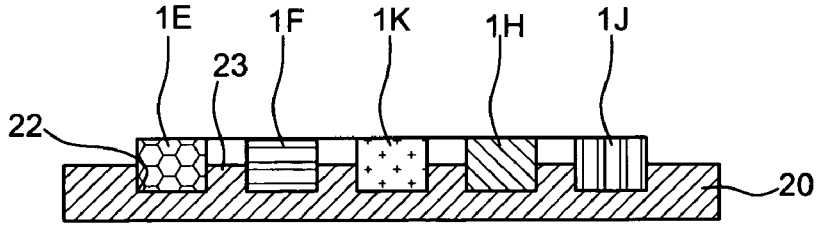
FIG. 6 is a cross-sectional view of FIG. 5 along line X-X'.
Figure 7:
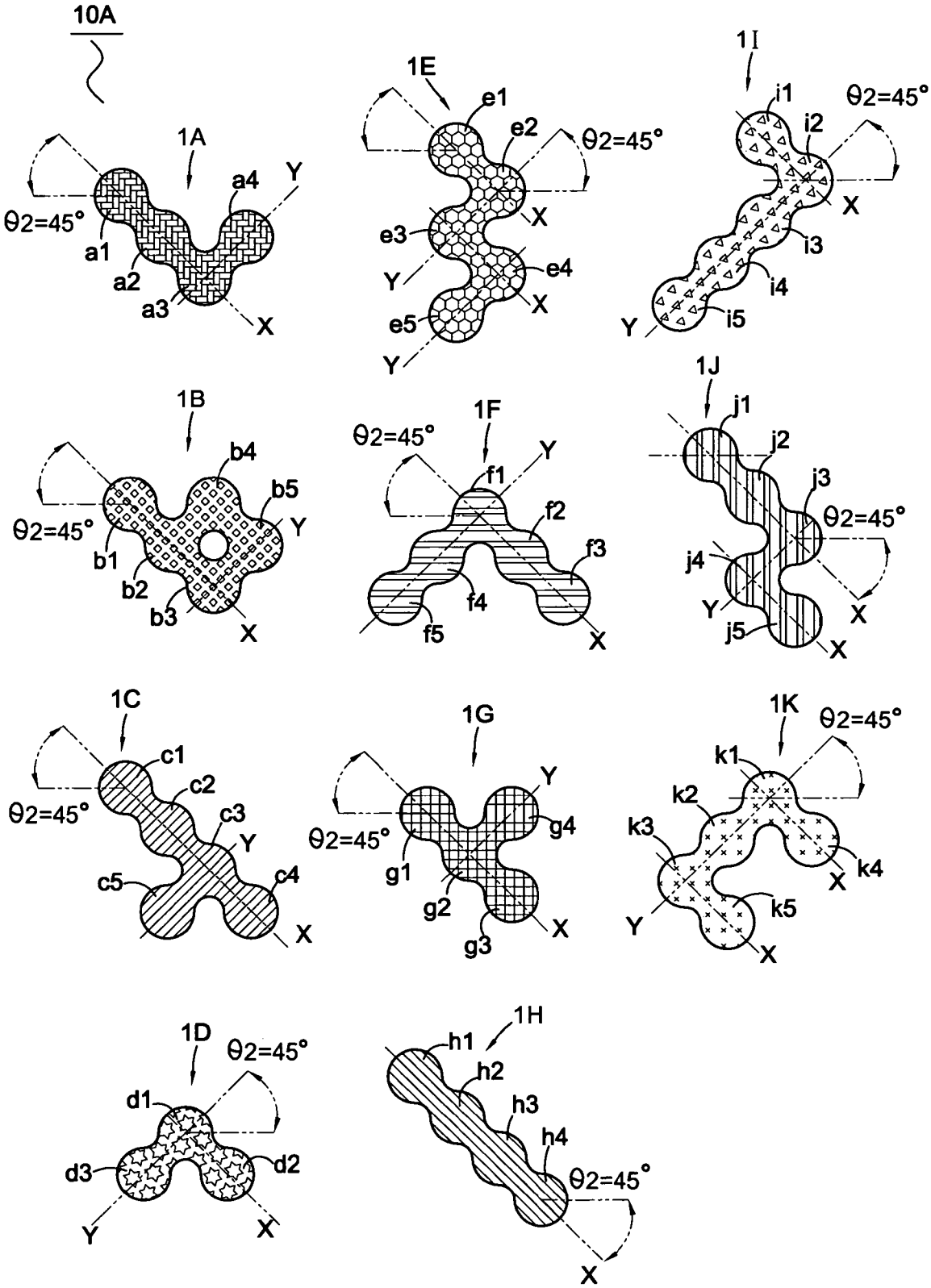
FIG. 7 is a schematic view of all 11 assembly pieces of the present embodiment.

FIG. 3 illustrates a top plan view of game tray of the first embodiment of the present invention; FIG. 4 shows a perspective view of the FIG. 3 coupled with all 11 building blocks; FIG. 5 is a schematic view of the FIG. 4; FIG. 6 is a cross-sectional view of FIG. 5 along line X-X'; and FIG. 7 is a schematic view of all 11 building blocks of the present embodiment.

FIGS. 3-7 disclose a toy block assembly puzzle comprises a game tray (20) and plurality of assembly pieces (10) which can be located into a concave recess (21) of said game tray (20).

In FIG. 3, showing a concave recess (21) is provided on a surface of said game tray (20), said concave recess (21) includes 50 concave slots (22), arranged in 11 rows; each odd row (row 1, 3, 5, 7, 9, 11) having 5 slots and each even row (row 2, 4, 6, 8, 10) having 4 slots; any adjacent odd and even row are staggered arranged where a slot of an even row inclines toward a slot of an odd row with an oblique angle of 45 degree. From another prospect, all odd and even rows are arranged into 10 diagonal rows, each having an angle of 45 degree enclosed by said diagonal row and a border of said game tray (20).

As illustrate in FIGS. 4 and 5, said assembly pieces consist 11 building blocks (1A~1K), each having a different shape and formed by 3~5 adjacent units; a total sum of units of said 11 building blocks (1A~1K) are 50 units. Said building blocks (1A~1K) are inserted diagonally into said 50 concave slots (22), provided on the game tray (20), with an oblique angle of 45 degree; said 11 building blocks (1A~1K) consist following shapes, illustrating by X-axis and Y-axis of a vector, wherein:

The block (1A) is formed by 4 units (a1~a4), a first to third unit (a1~a3) are aligned vertically along the X-axis while a fourth unit (a4) and the third unit (a3) are aligned horizontally along the Y-axis;

The block (1B) is formed by 5 units (b1~b5), a first to third unit (b1~b3) and a fourth to fifth unit (b4, b5) are aligned vertically along the X-axis, while the second and forth units (b2, b4), the third and fifth unit (b3, b5), both are aligned horizontally along two parallel Y-axes;

The block (1C) is formed by 5 units (c1~c5), a first to forth unit (c1~c4) are aligned vertically along the X-axis while a fifth unit and the third unit (c5, c3) are aligned horizontally along the Y-axis;

The block (1D) is formed by 3 units (d1~d3), a first and second unit (d1~d2) are aligned vertically along the X-axis while a third and the second unit (d3, d2) are aligned horizontally along the Y-axis;

The block (1E) is formed by 5 units (e1~e5), a first and second unit (e1~e2), a third and forth unit (e3, e4), both are aligned vertically along two parallel X-axes, while the second and the third unit (e2, e3), a fifth and the forth unit (e5, e4), both are aligned horizontally along two parallel Y-axes;

The block (1F) is formed by 5 units (f1~f5), a first to third unit (c1~c4) are aligned vertically along the X-axis, while the first, a forth and a fifth unit (f1, f4, f5) are aligned horizontally along the Y-axis;

The block (1G) is formed by 4 units (g1~g4), a first to third unit (g1~g3) are aligned vertically along the X-axis, while a second and the forth unit (g2, g4) are aligned horizontally along the Y-axis;

The block (1H) is formed by 4 units (h1~h4), a first to forth unit (h1~h4) are aligned vertically along the X-axis;

The block (1I) is formed by 5 units (i1~i5), a first and second unit (i1,i2) are aligned vertically along the X-axis, while the second to fifth unit (i2~i5) are aligned horizontally along the Y-axis;

The block (1J) is formed by 5 units (j1~j5), a first to third unit (j1~j3), a forth and fifth unit (j4, j5), both are aligned vertically along two parallel X-axes, while the third and forth (j3, j4) are aligned horizontally along the Y-axis;

The block (1K) is formed by 5 units (k1~k5), a first and forth unit (k1, k4), a third and fifth (k3, k5), both are aligned vertically along two parallel X-axes, while the first to third unit (k1~k3) are aligned horizontally along the Y-axis.

In accordance with FIGS. 4 and 5, each slot (22) of said recess (21) is in a concave circular shape and adjoined with each other by a channel (24); both side walls of said channel (24) having a concave arc shape, forming 31 columns (23) inside said recess (21); all 31 columns (23) are arranged in 9 rows, each odd row (row 1, 3, 5, 7, 9) having 3 columns and each even row (row 2, 4, 6, 8) having 4 columns; all columns in both the odd rows and even rows are staggered arranged. Since all columns (23) are placed in accordance with the arrangement of said slots (22), therefore, any adjacent odd and even row of columns (23) are staggered arranged where a column of an even row inclines toward a column of an odd row by an oblique angle of 45 degree.

Second Embodiment

Figure 8:
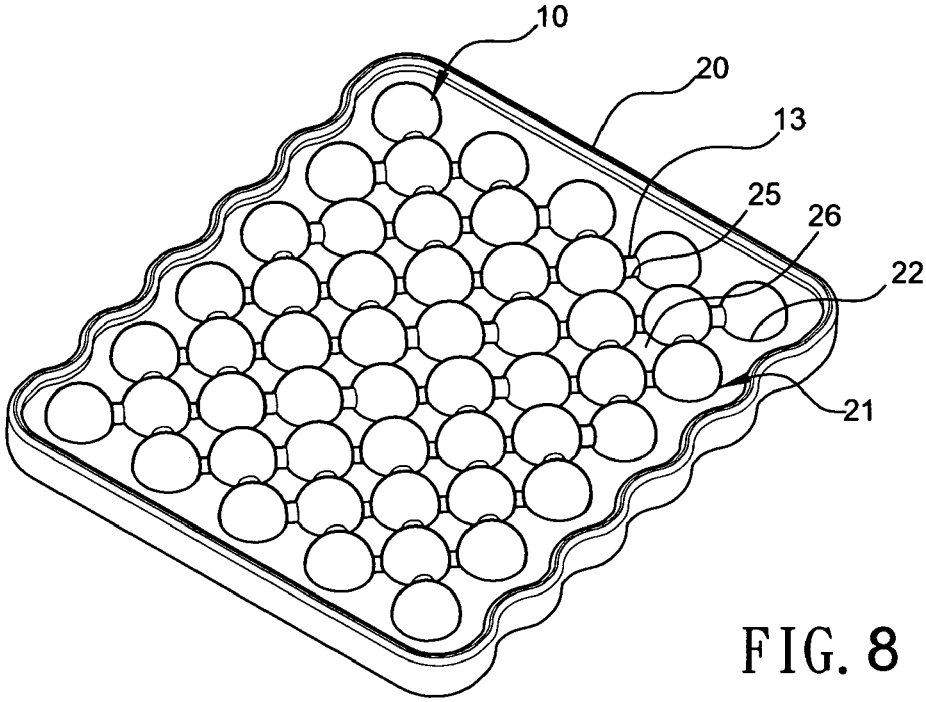
FIG. 8 is a perspective view of the game tray of the second embodiment coupled with all 11 assembly pieces.
Figure 9:
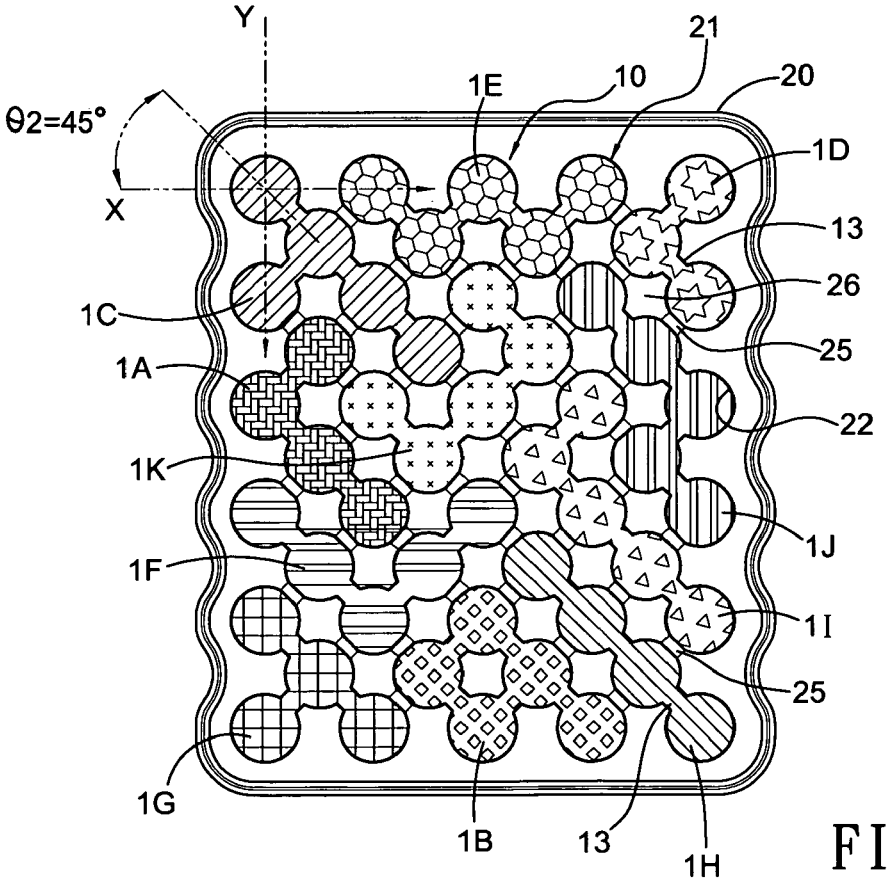
FIG. 9 is a top plan view of FIG. 8.

FIG. 8 is a perspective view of the game tray of the second embodiment coupled with all 11 assembly pieces, and FIG. 9 is a top plan view of aforementioned FIG. 8. In accordance with the drawings, the second embodiment of the present invention characterizes in that each slot (22) of said recess (21) is in a concave semi-spherical shape and adjoined by a trench (25); edges of said slot (22) and trench (25) are connected, forming 31 octagonal cylinders (26) inside said recess (21); all 31 octagonal cylinders (26) are arranged in 9 rows, each odd row (row 1, 3, 5, 7, 9) having 3 cylinders and each even row (row 2, 4, 6, 8) having 4 cylinders; all cylinders are also arranged as same as said columns of the first embodiment which means that adjacent odd and even rows of cylinders are staggered arranged where a column of an even row inclines toward a column of an odd row with an oblique angle of 45 degree. Said units of all 11 building blocks (1A~1K) are formed in spherical shape and adjoined by a shaft (13), said shaft (13) fits perfectly in the trench (25).

Third Embodiment

Figure 10:
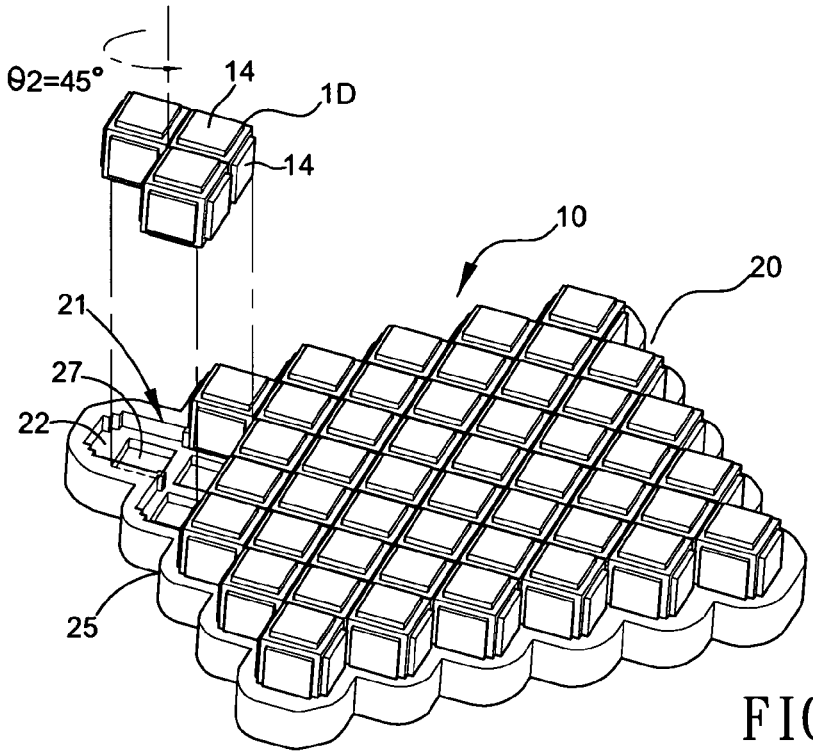
FIG. 10 is a perspective view of the game tray of the third embodiment coupled with all 11 assembly pieces.
Figure 11:
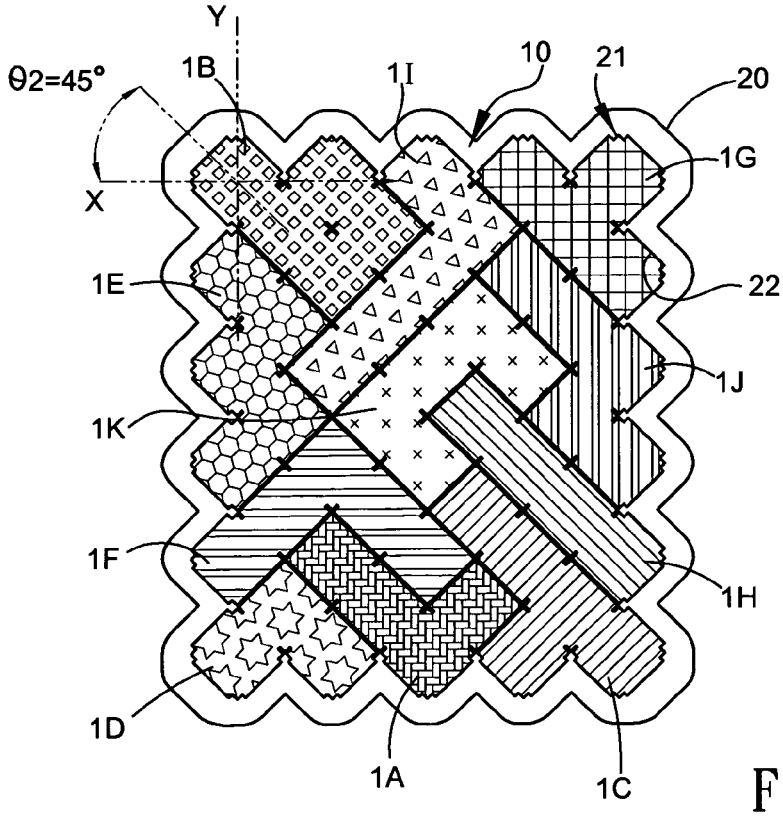
FIG. 11 is a top plan view of FIG. 10.

As showing in FIGS. 10 and 11, the third preferred embodiment is characterized in that each slot (22) of said recess (21) formed a concave square and arranged adjacently, and a groove (27) is disposed on the bottom of each slot (22). Said units of all 11 building blocks (1A~1K) are cubes and having a projection part (14) disposed on each face; said projection part (14) fits perfectly in the groove (27).

Fourth Embodiment

Figure 12:
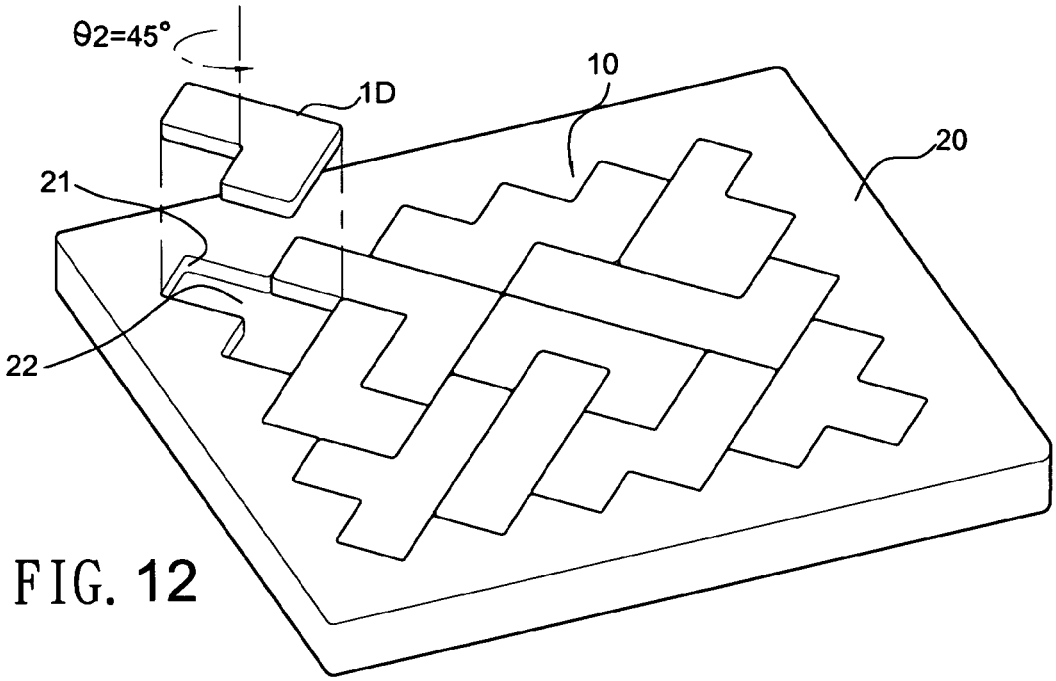
FIG. 12 is a perspective view of the game tray of the forth embodiment coupled with all 11 assembly pieces.
Figure 13:
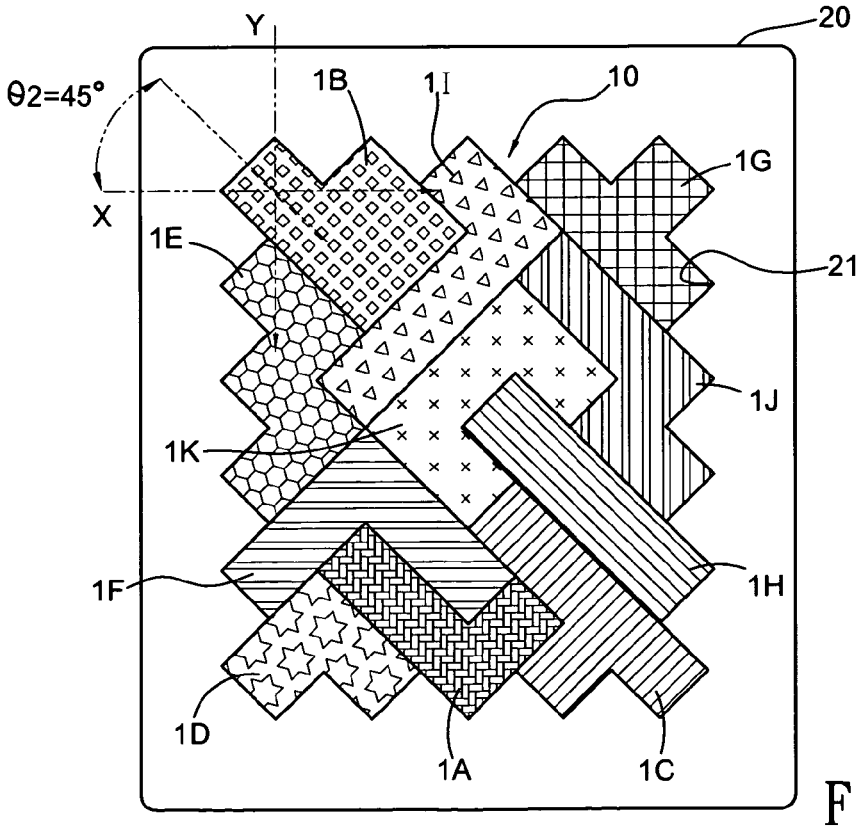
FIG. 13 is a top plan view of FIG. 12.

As illustrated in FIGS. 12 and 13, the difference between the fourth and previous embodiments is characterized in that each slot (22) of said recess (21) is a concave square and arranged adjacently; each unit of all 11 building blocks (1A~1K) is a cuboid and fits perfectly in each slot (22).

What disclosed above are only the preferred embodiments of the present invention and it is therefore not intended that the present invention be limited to particular embodiment disclosed. It will be understood by those skilled in the art that various equivalent changes may be made depending on specification and drawings of present invention without departing from the scope of the present invention.

What is claimed is:

1. A toy block assembly puzzle comprising: a game tray (20) and plurality of assembly pieces (10) which will be arranged in a concave recess (21) of said game tray (20), characterized in that:

Said concave recess (21) is provided on upper/base surface of said game tray (20), said concave recess (21) including 50 concave slots (22), arranged in 11 rows; each odd row (row 1, 3, 5, 7, 9, 11) having 5 slots and each even row (row 2, 4, 6, 8, 10) having 4 slots; all slots of said odd and even row are staggered arranged and each slot of said even row inclines toward the slots of said odd row by an angle of 45 degree;

Each slot (22) of said recess (21) is a concave circular shape and connected with each other by a channel (24); both side walls of said channel (24) having a concave arc shape, forming 31 columns (23) inside said recess (21); all 31 columns (23) are arranged in 9 rows, each odd row (row 1, 3, 5, 7, 9) having 3 columns and each even row (row 2, 4, 6, 8) having 4 columns; all columns in both odd and even rows are staggered arranged and each column of said even row inclines toward the columns of said odd row by an angle of 45 degree; said units of all 11 building blocks (1A~1K) are formed in oblate cylindrical shape and adjoined by a connecting element (12), the side wall of said connecting element (12) are in convex arc shape and fit perfectly in the channel (24);

Said assembly pieces (10) comprising 11 building blocks (1A-1K), each having a different shape and formed by 3~5 adjacent units; a total sum of units of said 11 building blocks (1A~1K) are 50 units; said building blocks (1A~1K) are placed inserted diagonally with an oblique angle of 45 degree, into said 50 concave slots (22), provided on the game tray (20); said 11 building blocks (1A~1K) consisting of the following shapes, illustrated by an X-axis and Y-axis of a vector, wherein:

The block (1A) is formed by 4 units (a1~a4), a first to third unit (a1~a3) are aligned vertically along the X-axis while a fourth unit (a4) and the third unit (a3) are aligned horizontally along the Y-axis;

The block (1B) is formed by 5 units (b1~b5), a first to third unit (b1~b3) and a fourth to fifth unit (b4, b5) are aligned vertically along the X-axis, while the second and forth units (b2, b4), the third and fifth unit (b3, b5), both are aligned horizontally along two parallel Y-axes;

The block (1C) is formed by 5 units (c1~c5), a first to forth unit (c1~c4) are aligned vertically along the X-axis while a fifth unit and the third unit (c5, c3) are aligned horizontally along the Y-axis;

The block (1D) is formed by 3 units (d1~d3), a first and second unit (d1~d2) are aligned vertically along the X-axis while a third and the second unit (d3, d2) are aligned horizontally along the Y-axis;

The block (1E) is formed by 5 units (e1~e5), a first and second unit (e1~e2), a third and forth unit (e3, e4), both are aligned vertically along two parallel X-axes, while the second and the third unit (e2, e3), a fifth and the forth unit (e5, e4), both are aligned horizontally along two parallel Y-axes;

The block (1F) is formed by 5 units (f1~f5), a first to third unit (c1~c4) are aligned vertically along the X-axis, while the first, a forth and a fifth unit (f1, f4, f5) are aligned horizontally along the Y-axis;

The block (1G) is formed by 4 units (g1~g4), a first to third unit (g1~g3) are aligned vertically along the X-axis, while a second and the forth unit (g2, g4) are aligned horizontally along the Y-axis;

The block (1H) is formed by 4 units (h1~h4), a first to forth unit (h1~h4) are aligned vertically along the X-axis;

The block (1I) is formed by 5 units (i1~i5), a first and second unit (i1,i2) are aligned vertically along the X-axis, while the second to fifth unit (i2~i5) are aligned horizontally along the Y-axis;

The block (1J) is formed by 5 units (j1~j5), a first to third unit (j1~j3), a forth and fifth unit (j4, j5), both are aligned vertically along two parallel Y-axes, while the third and forth (j3, j4) are aligned horizontally along the Y-axis;

The block (1K) is formed by 5 units (k1~k5), a first and forth unit (k1, k4), a third and fifth (k3, k5), both are aligned vertically along two parallel X-axes, while the first to third unit (k1~k3) are aligned horizontally along the Y-axis.

2. A toy block assembly puzzle comprising: a game tray (20) and plurality of assembly pieces (10) which will be arranged in a concave recess (21) of said game tray (20), characterized in that:

Said concave recess (21) is provided on upper/base surface of said game tray (20), said concave recess (21) including 50 concave slots (22), arranged in 11 rows; each odd row (row 1, 3, 5, 7, 9, 11) having 5 slots and each even row (row 2, 4, 6, 8, 10) having 4 slots; all slots of said odd and even row are staggered arranged and each slot of said even row inclines toward the slots of said odd row by an angle of 45 degree;

Each slot (22) of said recess (21) is a concave semi-spherical shape and connected with each other by a trench (25); edges of said slot (22) and trench (25) are connected, forming 31 octagonal cylinders (26) inside said recess (21); all 31 octagonal cylinders (26) are arranged in 9 rows, each odd row (row 1, 3, 5, 7, 9) having 3 cylinders and each even row (row 2, 4, 6, 8) having 4 cylinders; all cylinders in both the odd and even rows are staggered arranged and each cylinder of said even row inclines toward the cylinders of said odd row by an angle of 45 degree; said units of all 11 building blocks (1A~1K) are in spherical shape and adjoined by a shaft (13), said shaft (13) fits perfectly in the trench (25);

Said assembly pieces (10) comprising 11 building blocks (1A~1K), each having a different shape and formed by 3~5 adjacent units; a total sum of units of said 11 building blocks (1A~1K) are 50 units; said building blocks (1A~1K) are placed inserted diagonally with an oblique angle of 45 degree, into said 50 concave slots (22), provided on the game tray (20); said 11 building blocks (1A~1K) consisting of the following shapes, illustrated by an X-axis and Y-axis of a vector, wherein:

The block (1A) is formed by 4 units (a1~a4), a first to third unit (a1~a3) are aligned vertically along the X-axis while a fourth unit (a4) and the third unit (a3) are aligned horizontally along the Y-axis;

The block (1B) is formed by 5 units (b1~b5), a first to third unit (b1~b3) and a fourth to fifth unit (b4, b5) are aligned vertically along the X-axis, while the second and forth units (b2, b4), the third and fifth unit (b3, b5), both are aligned horizontally along two parallel Y-axes;

The block (1C) is formed by 5 units (c1~c5), a first to forth unit (c1~c4) are aligned vertically along the X-axis while a fifth unit and the third unit (c5, c3) are aligned horizontally along the Y-axis;

The block (1D) is formed by 3 units (d1~d3), a first and second unit (d1~d2) are aligned vertically along the X-axis while a third and the second unit (d3, d2) are aligned horizontally along the Y-axis;

The block (1E) is formed by 5 units (e1~e5), a first and second unit (e1~e2), a third and forth unit (e3, e4), both are aligned vertically along two parallel X-axes, while the second and the third unit (e2, e3), a fifth and the forth unit (e5, e4), both are aligned horizontally along two parallel Y-axes;

The block (1F) is formed by 5 units (f1~f5), a first to third unit (c1~c4) are aligned vertically along the X-axis, while the first, a forth and a fifth unit (f1, f4, f5) are aligned horizontally along the Y-axis;

The block (1G) is formed by 4 units (g1~g4), a first to third unit (g1~g3) are aligned vertically along the X-axis, while a second and the forth unit (g2, g4) are aligned horizontally along the Y-axis;

The block (1H) is formed by 4 units (h1~h4), a first to forth unit (h1~h4) are aligned vertically along the X-axis;

The block (1I) is formed by 5 units (i1~i5), a first and second unit (i1,i2) are aligned vertically along the X-axis, while the second to fifth unit (i2~i5) are aligned horizontally along the Y-axis;

The block (1J) is formed by 5 units (j1~j5), a first to third unit (j1~j3), a forth and fifth unit (j4, j5), both are aligned vertically along two parallel Y-axes, while the third and forth (j3, j4) are aligned horizontally along the Y-axis;

The block (1K) is formed by 5 units (k1~k5), a first and forth unit (k1, k4), a third and fifth (k3, k5), both are aligned vertically along two parallel X-axes, while the first to third unit (k1~k3) are aligned horizontally along the Y-axis.

* * * * *